US008303264B2

(12) United States Patent
Daniels et al.

(10) Patent No.: US 8,303,264 B2
(45) Date of Patent: Nov. 6, 2012

(54) DEVICE FOR ADJUSTING THE FLOW RATE OF A MOBILE OIL-INJECTED SCREW-TYPE COMPRESSOR

(75) Inventors: Ivo Daniels, Boom (BE); Fernand Marcel Albert C. Masschelein, Temse (BE)

(73) Assignee: Atlas Copco Airpower, Naamloze Vennootschap, Wilruk (BE)

( * ) Notice: Subject to any disclaimer, the term of this patent is extended or adjusted under 35 U.S.C. 154(b) by 680 days.

(21) Appl. No.: 11/922,988

(22) PCT Filed: Aug. 10, 2006

(86) PCT No.: PCT/BE2006/000087

§ 371 (c)(1),
(2), (4) Date: Jun. 5, 2009

(87) PCT Pub. No.: WO2007/019651

PCT Pub. Date: Feb. 22, 2007

(65) Prior Publication Data

US 2010/0040487 A1 Feb. 18, 2010

(30) Foreign Application Priority Data

Aug. 17, 2005 (BE) ..... 2005/0396

(51) Int. Cl.
*F04B 49/00* (2006.01)

(52) U.S. Cl. ..... 417/298; 137/115.01

(58) Field of Classification Search ..... 417/44.2, 417/298, 228, 540; 137/115.01
See application file for complete search history.

(56) References Cited

U.S. PATENT DOCUMENTS

| | | | | |
|---|---|---|---|---|
| 4,664,601 | A | 5/1987 | Uchida et al. | |
| 5,533,873 | A | 7/1996 | Kindl | |
| 6,146,100 | A | 11/2000 | Broucke | |
| 2001/0046443 | A1 * | 11/2001 | Van De Putte | 417/44.2 |
| 2006/0018769 | A1 | 1/2006 | Van Praag et al. | |

FOREIGN PATENT DOCUMENTS

| | | | |
|---|---|---|---|
| EP | 0 942 173 | A1 | 9/1999 |
| JP | 58-140498 | | 8/1983 |
| WO | WO 2004/018878 | A1 | 3/2004 |

* cited by examiner

*Primary Examiner* — Anh Mai
*Assistant Examiner* — Brenitra Lee
(74) *Attorney, Agent, or Firm* — Bacon & Thomas, PLLC

(57) ABSTRACT

A device for adjusting the flow rate of a screw- type compressor supplying compressed gas, having a control valve to supply a control pressure (Pn) which is in proportion to the gas pressure (Pw) as of a gas pressure (A); an electronic speed controller which sets a lower rotational speed (N) as the control pressure (Pr1) rises; an inlet valve controlled by the control pressure (Pr1) with a valve element which can freely move inside a housing and where a non-return valve is actuated by a spring provided in a line between the inlet valve and the control valve.

9 Claims, 3 Drawing Sheets

DEVICE FOR ADJUSTING THE FLOW RATE OF A MOBILE OIL-INJECTED SCREW-TYPE COMPRESSOR

BACKGROUND OF THE INVENTION

A. Field

The present invention concerns an improved device for adjusting the flow rate of a mobile oil-injected screw-type compressor.

B. Related Art

In particular, the present invention concerns an improved device for adjusting the flow rate of mobile oil-injected screw-type compressors which are driven by a thermal motor and which can typically provide operating pressures from 5 to 35 bar, whereby also the supplied flow rate of compressed gas can be adjusted in a sliding manner between 0 and 100%.

Such devices for adjusting the flow rate of a mobile oil-injected screw-type compressor which are driven by a thermal motor are already known, whereby the screw-type compressor is provided with an inlet and with an outlet onto which is connected a pressure vessel with an outlet pipe for supplying a compressed gas and whereby the device mainly consists of a control valve which is connected with its input to the pressure vessel via a pressure pipe and which, at its output, as of a certain pre-determined value of the pressure in the pressure pipe of the pressure vessel, supplies a control pressure which is in proportion to said pressure in the pressure pipe of the pressure vessel; an electronic speed controller for adjusting the rotational speed of the motor which is connected to the above-mentioned control pressure of the control valve via a pressure sensor and a first control line and which is such that, as the control pressure rises, the motor is set at a lower rotational speed; and of a pneumatically controlled inlet valve on the inlet of the compressor, which inlet valve consists of a housing in which a valve element can be shifted to and fro in the axial direction between an open and a closed position and which is sealed on one side of the valve element so as to form a pressure chamber which is connected to the control pressure of the control valve via a second control line.

With most known devices for adjusting the flow rate of a mobile oil-injected screw-type compressor, the valve element of the inlet valve of the compressor is moreover pushed in an open position by means of a compression spring during start up.

A disadvantage of these known devices for adjusting the flow rate of a mobile oil-injected screw-type compressor is that, during a cold start up, there is not enough torque.

This is due to the fact that the inlet valve, during the start up, is pushed in an open position by the compression spring, such that while the screw-type compressor increases speed from a standstill up to the required minimum rotational speed, air is drawn in and compressed.

The compression of air hinders the screw-type compressor in gaining its rotational speed, and that is why a high torque is required.

With other known devices, this low torque problem during a cold start up is remedied by keeping the inlet valve in a closed position during start up until the screw-type compressor has reached the required minimum rotational speed.

A disadvantage of these known devices, however, is that they consume a lot and consequently are not economical, so that refueling is often required, which is time-consuming and laborious.

The present invention aims to remedy one or several of the above-mentioned and other disadvantages in a simple manner.

BRIEF SUMMARY OF THE INVENTION

To this end, the invention concerns an improved device for adjusting the flow rate of a mobile oil-injected screw-type compressor of the above-mentioned type, whereby the valve element can move freely in the housing and whereby, in the line connecting the pressure chamber of the inlet valve to the control pressure of the control valve is provided a non-return valve actuated by means of a spring which can be pushed open by the control pressure.

An advantage of such an improved device is that it provides a very simple solution to the high torque problem when starting the screw-type compressor, and moreover it consumes considerably less.

An additional advantage is that the solution is very simple and can moreover be easily applied to existing compressors by taking away the spring from the inlet valve and by incorporating a spring-actuated non-return valve.

According to a preferred embodiment of an improved device for adjusting the flow rate of a mobile oil-injected screw-type compressor, a bypass line is provided between the pressure pipe on the pressure vessel and the above-mentioned second control line of the inlet valve, more particularly the part of the control line between the inlet valve and the non-return valve, whereby in this bypass line is provided a normally closed load valve which is opened as the compressor is started up.

An advantage of an improved device according to this preferred embodiment is that, by opening the above-mentioned load valve which is normally closed in the bypass line during start up, the pressure available in the pressure vessel is put directly on the pressure chamber behind the valve element, such that this valve element is retained in a closed position during start up, so that a lower torque is required during said start up.

BRIEF DESCRIPTION OF THE DRAWINGS

In order to better explain the characteristics of the invention, the following preferred embodiment of an improved device for adjusting the flow rate of a mobile oil-injected screw-type compressor according to the invention is given as an example only without being limitative in any way, with reference to the accompanying drawings, in which.

DESCRIPTION OF PREFERRED EMBODIMENTS OF THE INVENTION

Figure 1:
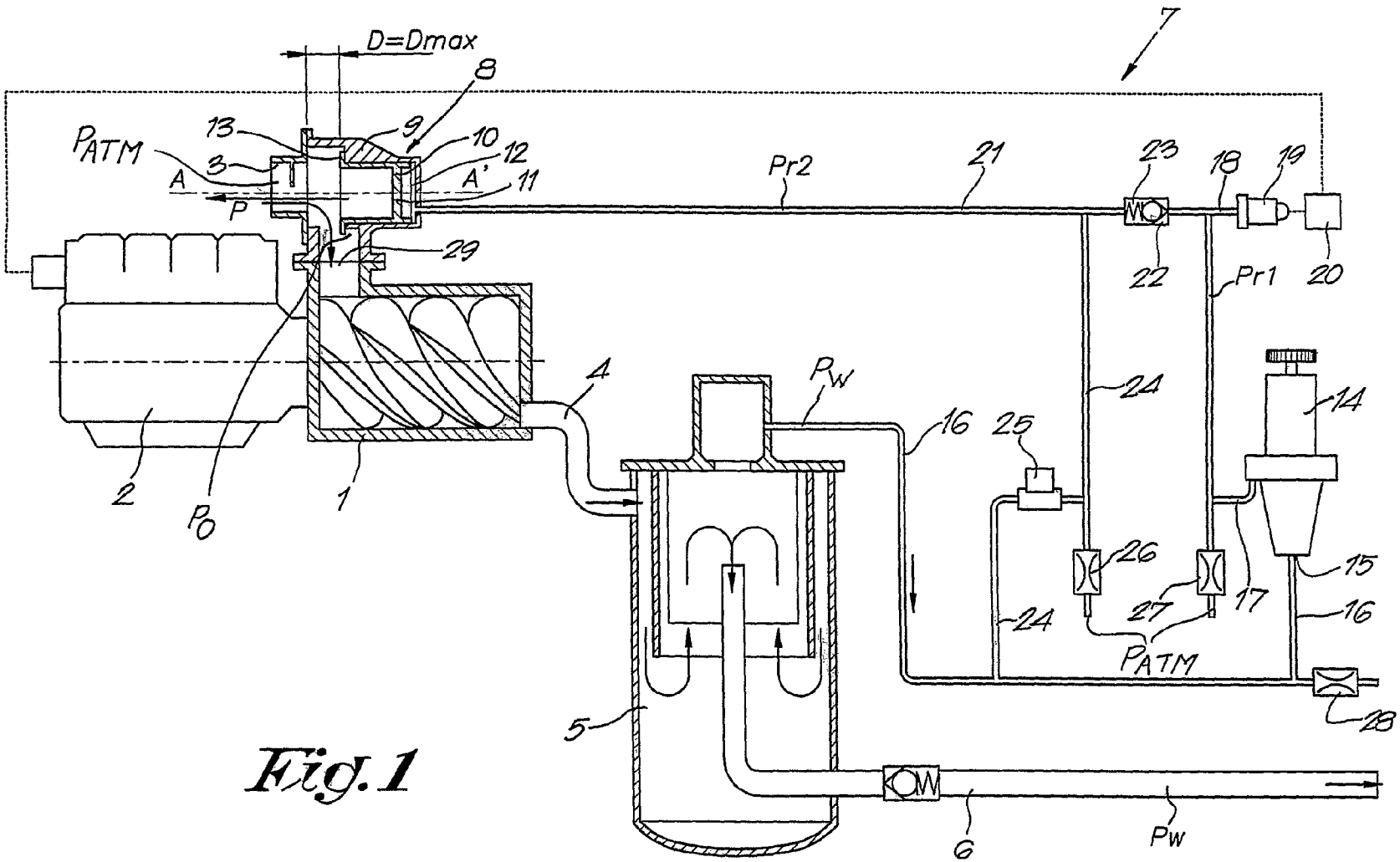
FIG. 1 schematically represents a mobile oil-injected screw-type compressor in which an improved device according to the invention has been applied for adjusting the flow rate.
Figure 2:
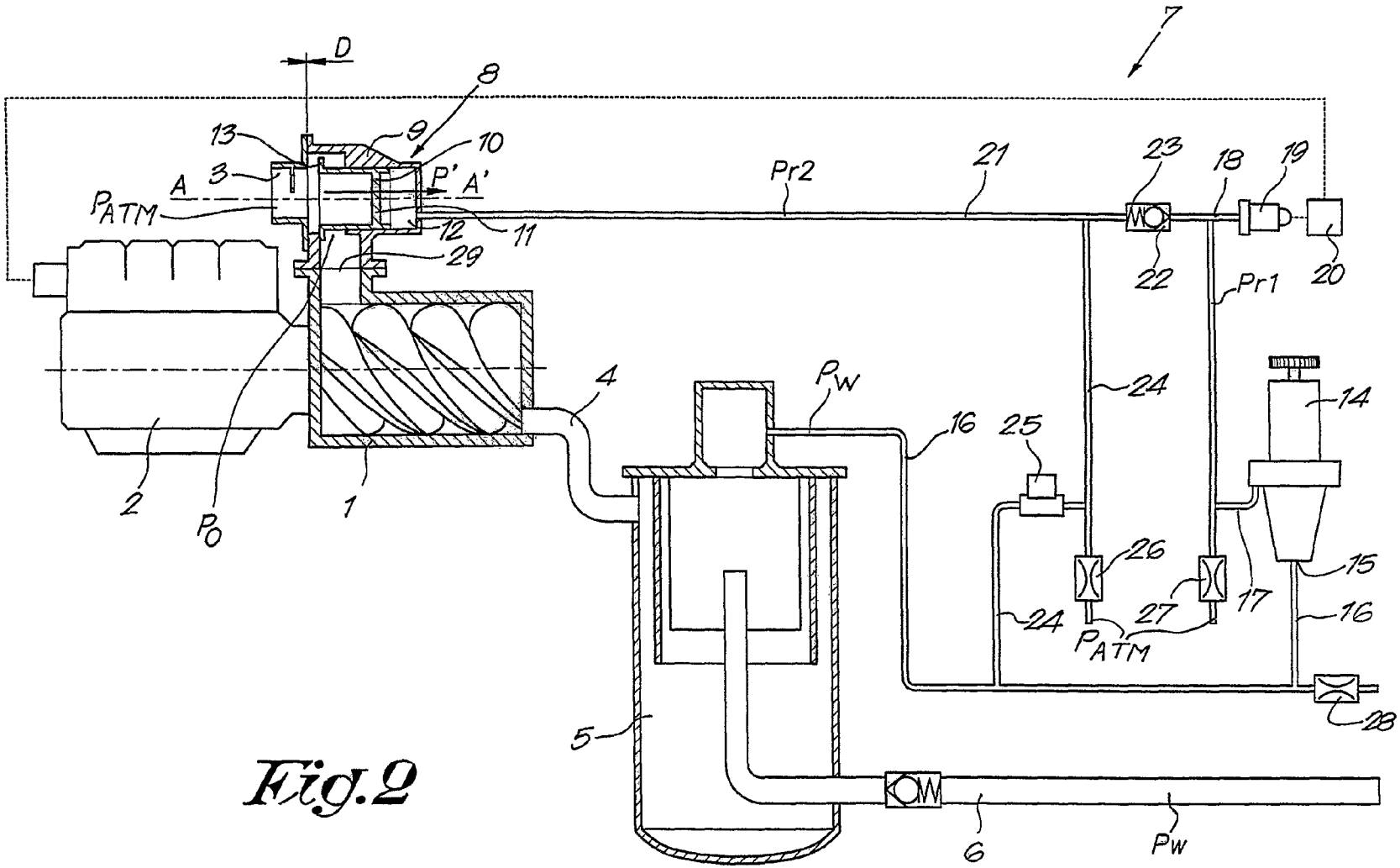
FIG. 2 represents the device from FIG. 1, but in another position.

FIGS. 1 and 2 represent a screw-type compressor 1 which is driven by a thermal motor 2 and which is provided with an inlet 3 for drawing in a gas to be compressed and with an outlet 4 onto which is connected a pressure vessel 5.

Via an outlet pipe 6 of the pressure vessel 5, compressed gas under a certain operating pressure $P_w$ is drawn off to be used in all sorts of applications, such as for example to drive pneumatic hammers, or to feed a compressed air line, etc.

In order to adjust the flow rate through the screw-type compressor 1, provided an improved device 7 according to the invention is further provided.

This improved device 7 mainly consists of a pneumatically controlled inlet valve 8 which is provided on the inlet 3 of the screw-type compressor 1 and which is formed of a housing 9 in which a valve element 10 can be shifted to and fro in the axial direction AA' between an open position, whereby the inlet opening D is maximal and is equal to $D_{max}$, as is represented in FIG. 1, and a closed position, whereby the inlet opening D is equal to 0, as is represented in FIG. 2.

This valve element 10 is sealed on one side 11, in particular on the side opposite the inlet 3, so as to form a pressure chamber 12.

Whereas with most known types of devices for adjusting the flow rate of a mobile oil-injected screw-type compressor 2, the above-mentioned valve element 10 is usually pushed in the open position by a compression spring, no compression spring is provided in the device 7 according to the invention, and the valve element 10 without compression spring can thus freely move in the housing 9.

Further, in the example shown, the valve element 10 is provided with a collar 13 on its free end on the side of the inlet 3.

The improved device 7 further has a control valve 14 with an input 15 which is connected to the pressure vessel 5 via a pressure pipe 16, whereby, through this control valve 14, a control pressure $P_{r1}$ is supplied to an output 17 as a function of the operating pressure $P_w$ at its input 15.

Figure 3:
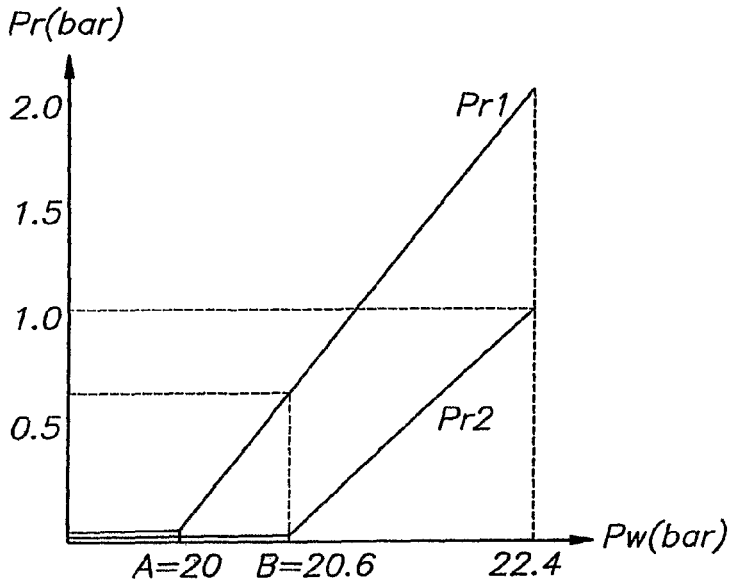
FIG. 3 graphically illustrates the relation between certain pressures in the device of the FIGS. 1 and 2.

Typically, as is illustrated in FIG. 3, as soon as the operating pressure $P_w$ has exceeded a pre-determined threshold value A, a control pressure $P_{r1}$ is built up at the output 17 of the control valve 14 which increases in proportion to the rising operating pressure $P_w$.

In the given example of FIG. 3, said threshold value A for the operating pressure amounts to 20 bar.

Via a first control line 18, the control pressure $P_{r1}$ is guided from the output 17 of the control valve 14 up to a pressure sensor 19. This pressure sensor 19 transforms the control pressure $P_{r1}$ into an electric signal which is sent to an electronic speed controller 20 for adjusting the rotational speed N of the thermal motor 2.

Figure 4:
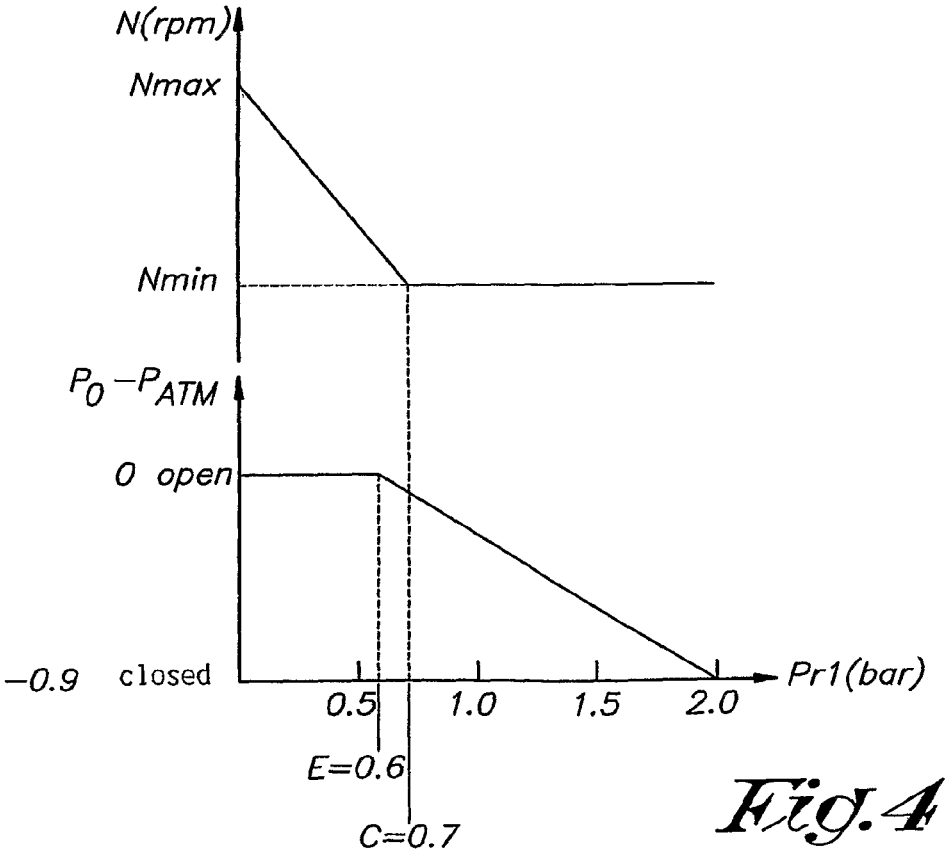
FIG. 4 graphically illustrates the rotational speed of the motor and the underpressure behind the inlet valve as a function of a control pressure in the device of FIGS. 1 and 2.

The electronic speed controller 20 is such that, as the control pressure $P_{r1}$ rises, the motor 2 is set at a lower rotational speed, as is schematically represented in FIG. 4, whereby the rotational speed N of the thermal motor 2 is represented as a function of the control pressure $P_{r1}$.

The motor is adjusted between a maximum and a minimum rotational speed, represented in FIG. 4 by $N_{max}$ and $N_{min}$ respectively.

The output 17 of the control valve 14 is also connected to the above-mentioned pressure chamber 12 at the inlet valve 8 via a second control line 21, in which is also provided a non-return valve 22 which is actuated by means of a spring 23 and which is pushed open when the control pressure $P_{r1}$ behind the control valve 14 is sufficient to overcome the force of the spring 23.

As can be seen in FIG. 3, the force which is required to compress the spring 23 of the non-return valve 22 makes sure that the threshold value B of the operating pressure at which a control pressure $P_{r2}$ is guided to the pressure chamber 12 is somewhat higher than the threshold value A of the operating pressure at which a control pressure $P_{r1}$ is created.

In the given example, this threshold value B of the operating pressure is 20.6 bar.

The evolution of the control pressure $P_{r2}$ behind the non-return valve 22 for controlling the inlet valve 8 is also schematically represented in FIG. 3 as a function of the operating pressure $P_w$, and it appears to be somewhat smaller than the control pressure $P_{r1}$ available on the output 17 of the control valve 14 and which is used as the control pressure $P_{r1}$ of the electronic speed controller 20.

In this manner is obtained that a control pressure $P_{r1}$ is first presented to the pressure sensor 19 to be transformed into an electric signal for the electronic speed controller 20, and that only later, at slightly higher operating pressures $P_w$, a control pressure $P_{r2}$ is guided to the pressure chamber 12.

It has been found by experience that such an adjustment, whereby first the rotational speed N of the motor is adjusted and only then the adjustment at the inlet opening D takes place, has a positive effect on the consumption of the screw-type compressor 1.

In the embodiment as shown, another bypass line 24 is provided between the pressure pipe 16 on the pressure vessel 5 and the second control line 21, in particular in the part 20 of the control line 21 between the inlet valve 8 and the non-return valve 22, whereby in this bypass line 24 is provided a cut-off valve or what is called a load valve 25 which is normally closed.

This load valve 25 is an electromagnetic valve which may be open or closed, depending on whether the terminal clamps of said load valve 25 are either or not live.

The bypass line 24 makes it possible to subject the pressure chamber 12 directly to the operating pressure $P_w$ in the pressure vessel 5, so that the working of the control valve 14 and of the non-return valve 22 is short-circuited.

In the example, the bypass line 24, both control lines 18 and 21, as well as the pressure pipe 16 are respectively provided with throttled blow-off openings 26, 27 and 28 which make it possible to drain off any condensed water.

The use and working of an improved device 7 for adjusting the flow rate of a mobile oil-injected screw-type compressor 1 according to the invention is simple and as follows.

When starting the screw-type compressor 1, the valve element 10 is normally in the closed position, as is represented in FIG. 2, since, when the screw-type compressor 1 was stopped during any preceding use, the operating pressure $P_w$ of the pressure vessel 5 was guided to the pressure chamber 12 via the bypass line 24, so that under this operating pressure $P_w$, the valve element 10 was put in the closed position.

As the valve element 10 can be moved in the horizontal or practically horizontal direction in the housing 9 of the valve element 10, after the screw-type compressor 1 has been stopped, the gravitational force will not have any influence on the position of the valve element 10, and the valve element 10 will stay in its closed position.

When the thermal motor 2 is started with the valve element 10 in the closed position so as to drive the screw-type compressor 1, an underpressure $P_0$ will be created in relation to the atmospheric pressure $P_{atm}$ at the inlet 3, on the lower side 29 behind the collar 13 of the valve element 10.

Due to the difference between the atmospheric pressure $P_{atm}$ and the pressure $P_0$ behind the collar 13, a force will be exerted on the collar 13 of the valve element 10 in the direction P', as a result of which the valve element 10 will be inclined to move in this direction P' into an open position, which is disadvantageous when starting up the screw-type compressor 1, as a much larger torque is required to start up the screw-type compressor 1 with an open inlet 3.

In order to prevent this, the load valve 25 in the bypass line 24 is opened by means of an electric signal, such that the operating pressure $P_w$ which is built up in the pressure vessel 5 by the screw-type compressor 1 is guided via the control line 21 to the pressure chamber 12 behind the valve element 10.

The non-return valve 22 prevents the operating pressure $P_w$ from being guided to the first control line 18 and the pressure sensor 19.

The electric signal with which the load valve 25 is opened is also used to bridge the electronic speed controller 20, whereby one makes sure that the rotational speed N of the thermal motor 2 is set at its minimum value $N_{min}$.

As long as the electric signal is switched on, only a limited operating pressure $P_w$ can be built up in the pressure vessel 5 due to the low rotational speed $N_{min}$ of the motor 2 and the opened load valve 25, which is much lower than the threshold value A whereby the control valve 14 supplies a control pressure $P_{r1}$ to the output 17, so that no control pressure $P_{r1}$ can be formed.

This operating pressure $P_w$ which is guided to the pressure chamber 12 behind the valve element 10 will provide for the necessary counterpressure so as to compensate for the force on the collar 13 of the valve element 10 resulting from the difference in pressure $P_{atm}-P_0$, so that the valve element 10 will stay in its closed position during start up until the screw-type compressor 1 has reached its minimal rotational speed $N_{min}$.

At that moment, the above-mentioned electric signal can be switched off, so that the electronic speed controller 20 is no longer bridged and the rotational speed N of the motor immediately proceeds to its maximum value $N_{max}$, as there is no control pressure $P_{r1}$ available.

Further, as the electric signal falls away, also the load valve 25 will be closed and the pressure in the pressure chamber 12 of the inlet valve 8, via the throttled blow-off opening 26, will drop until it practically reaches the atmospheric pressure $P_{atm}$, as a result of which the force on the collar 13 resulting from the above-mentioned underpressure $P_0$ in the inlet 3 on the lower side 29 of the valve element 10 will be no longer compensated, and the valve element 10 will then shift in the direction P' into the open position.

While the inlet valve is being opened, the pressure $P_0$ behind the collar 13 will rise until, when the inlet is entirely open, the atmospheric pressure $P_{atm}$ will also prevail there.

As the screw-type compressor 1 supplies compressed air to the pressure vessel 5, the operating pressure $P_w$ in the pressure vessel 5 will gradually rise, at least as long as the supply of compressed gas is larger than the discharge thereof via the outlet pipe 6.

This rise of the operating pressure $P_w$ can also be observed via the pressure pipe 16 at the input 15 of the control valve 14.

As long as the operating pressure $P_w$ does not exceed a certain set threshold value A, no control pressure $P_{r1}$ will be supplied at the output 17 of the control valve 14, as a result of which the thermal motor 2 is driven at its maximum rotational speed $N_{max}$.

However, as soon as the operating pressure $P_w$ rises above the threshold value A, the control valve 14 will supply a control pressure $P_{r1}$ at its output 17 which rises in proportion to the rising operating pressure $P_w$.

This control pressure $P_{r1}$, via control line 18, reaches the pressure sensor 19 which sends an electric signal to the electronic speed controller 20 by which the rotational speed N of the motor 2 is adjusted, as is represented in FIG. 4, whereby at a rising control pressure $P_{r1}$, the rotational speed N is set at increasingly lower values until, as soon as the control pressure $P_{r1}$ exceeds a value C, the minimum value $N_{min}$ is reached.

By making the motor 2 turn faster or slower, the flow rate through the screw-type compressor 1 will logically rise or drop respectively.

When, for example, the flow rate of compressed gas which is taken via the outlet pipe 6 rises, the operating pressure $P_w$ in the pressure vessel 5 will drop, which results in a dropping control pressure $P_{r1}$ in the first control line 18 and thus also in a rise of the rotational speed N of the motor, such that the flow rate of compressed gas, which is supplied by the screw-type compressor 1, will increase, so that the increasing demand for compressed gas at the outlet pipe 6 can be met.

When the take-off of compressed gas via outlet pipe 6 lessens, the reverse will happen of course.

In other words, thanks to the adjustment of the rotational speed N of the motor 2, the flow rate supplied by the screw-type compressor 1 is geared to the flow rate taken via the outlet pipe 6, at least as far as the above-mentioned flow rates are situated within certain limits, whereby a balance between both flow rates can be created at any random rotational speed N between $N_{max}$ and $N_{min}$.

However, when the motor 2 is driven at the minimal rotational speed $N_{min}$ and no balance can be reached between the flow rates, for example as an insufficient amount of compressed gas is taken at the outlet pipe 6, the operating pressure $P_w$ and thus also the control pressure $P_{r1}$ will further rise.

On the other hand, the control pressure $P_{r1}$ is directed to the spring-actuated or biased non-return valve 22 via the control line 21 as well.

Opening the non-return valve 22 against the pre-stress of the spring 23 requires, as is represented in FIG. 4, a certain control pressure E which in this case amounts to 0.6 bar.

What it comes down to, is that a control pressure $P_{r2}$ will only be guided to the pressure chamber 12 when the operating pressure $P_w$ has exceeded the threshold value B of 20.6 bar in this case, as is represented in FIG. 3.

As the control pressure $P_{r2}$ rises, the valve element 10 will move in the direction of the arrow P to a position which is more and more closed, as a result of which the flow rate through the screw-type compressor 1 is further restricted.

When the control pressure $P_{r2}$ in the pressure chamber 12 rises to 1 bar, the valve element will entirely seal the inlet 3 of the screw-type compressor 1.

The pre-stress of the spring 23 of the non-return valve 22 is such that the non-return valve 22 opens at a control pressure E which is somewhat lower than the control pressure C, whereby the above-mentioned electronic speed controller 20 sets the motor 2 at its minimum rotational speed $N_{min}$.

As is represented in FIG. 4, this control pressure E at which the non-return valve 22 opens is 0.6 bar, whereas the control pressure C at which the speed controller 20 sets the motor 2 at its minimum rotational speed $N_{min}$ is about 0.7 bar.

This is advantageous in that, with an improved device 7 according to the invention, the flow rate through the screw-type compressor 1 is first restricted by reducing the rotational speed N of the motor 2, as a result of which less fuel is consumed, and only then, when the motor is practically turning at its minimal rotational speed $N_{min}$, the flow rate through the screw-type compressor 1 is further restricted by closing the inlet valve 8.

In this manner, the flow rate which is supplied through the screw-type compressor 1 can be sufficiently adjusted, whereby a balanced situation is each time obtained with the flow rate taken at the outlet pipe 6.

For a small range of control pressures $P_{r1}$, namely between 0.6 and 0.7 bar in this case, there is an adjustment of the rotational speed N as well as at the inlet opening D.

This small overlap provides for a smooth transition between both adjustments, and in a general manner it makes sure that the flow rate of the screw-type compressor can be adjusted in a sliding manner.

It is also clear that with such an improved device 7 according to the invention, the high torque problem when starting the screw-type compressor 1 is solved in a simple manner.

The invention is by no means limited to the embodiment given as an example and represented in the figures.

Thus, the pressure values and the linear course of the curves represented in FIGS. 3 and 4 are only examples to illustrate the working of the improved device 7. However, the pressure values may largely vary and the course of the curves may for example be non-linear.

The invention is by no means restricted to the embodiment described as an example and represented in the accompanying drawings; on the contrary, such an improved device for adjusting the flow rate of a screw-type compressor can be realised in many shapes and dimensions while still remaining within the scope of the invention.

The invention claimed is:

1. Device for adjusting the flow rate of a mobile oil-injected screw-type compressor driven by a thermal motor, the compressor having a gas inlet, a gas outlet and a pressure vessel connected to the outlet, the pressure vessel having an outlet pipe arranged to supply compressed gas, said device comprising:

a control valve having a control valve inlet connected to the pressure vessel via a pressure pipe and which is arranged to supply a control pressure at an outlet thereof at a certain preset value of the pressure in the pressure pipe, which control pressure is in proportion to said pressure in the pressure pipe;

an electronic speed controller arranged to adjust the rotational speed of the motor and which is connected to the control pressure of the control valve via a pressure sensor and a first control line, said speed controller arranged such that, as the control pressure rises, the motor is set at a lower rotational speed;

a pneumatically controlled gas inlet valve at the gas inlet of the compressor, said gas inlet valve comprising a housing in which a valve element is mounted for axial reciprocal motion between an open and a closed position, and which is sealed on one side of the valve element so as to form a pressure chamber which is connected via a second control line to the control pressure of the control valve, said valve element being freely moveable in the housing, and a non-return valve biased towards a closed position by a spring and disposed in the line which connects the pressure chamber of the gas inlet valve to the control pressure of the control valve, said valve being movable towards an open position by the control pressure.

2. Device according to claim 1, wherein the pneumatically controlled gas inlet valve includes a start up closing arrangement that is arranged to maintain the valve element in a closed position during compressor start up.

3. Device according to claim 2, wherein the start up closing arrangement comprises a bypass line between the pressure pipe and the second control line of the inlet valve, namely a part of the control line between the inlet valve and the non-return valve, and wherein the bypass line is provided with a load valve which is normally closed, but which opens upon compressor start up.

4. Device according to claim 1, wherein the valve element is moveable inside the housing of the inlet valve in the horizontal or practically horizontal direction.

5. Device according to claim 1, wherein the valve element is provided with a collar.

6. Device according to claim 1, wherein a throttled blow-off opening is provided in the first control line, via which opening compressed gas in the control line may escape into the atmosphere.

7. Device according to claim 3, wherein a throttled blow-off opening is provided in the bypass line.

8. Device according to claim 1, wherein a throttled blow-off opening is provided in the pressure pipe with which the control valve is connected to the pressure vessel.

9. Device according to claim 1, wherein a pre-stress bias of the spring of the non-return valve is such that the non-return valve opens at a first control pressure which is somewhat lower than a second control pressure at which the motor is set at its minimum rotational speed.

* * * * *